US005498331A

United States Patent [19]

Monteith

[11] Patent Number: 5,498,331

[45] Date of Patent: Mar. 12, 1996

[54] TANK INTERCEPTOR

[75] Inventor: Joseph G. Monteith, Mississauga, Canada

[73] Assignee: 1137361 Ontario Limited, Ontario, Canada

[21] Appl. No.: 337,393

[22] Filed: Nov. 8, 1994

[51] Int. Cl.[6] ..... B01D 21/02

[52] U.S. Cl. ..... 210/170; 210/521; 210/532.1; 210/538

[58] Field of Search ..... 210/154, 170, 210/521, 532.1, 538, 540

[56] References Cited

U.S. PATENT DOCUMENTS

| | | | |
|---|---|---|---|
| 942,907 | 12/1909 | Huff . | |
| 1,237,068 | 8/1917 | Loeb | 210/538 |
| 1,844,443 | 2/1932 | Schmidt . | |
| 2,393,498 | 1/1946 | Miller | 210/538 |
| 2,764,545 | 9/1956 | Primich | 210/538 |
| 3,221,881 | 12/1965 | Weiler et al. | 210/136 |
| 3,282,436 | 11/1966 | Malm | 210/532.1 |
| 3,374,894 | 3/1968 | Webster | 210/532.1 |
| 3,567,024 | 3/1971 | McCormick | 210/170 |
| 3,779,385 | 12/1973 | Strohecker | 210/154 |
| 4,073,734 | 2/1978 | Lowrie | 210/532.1 |
| 4,136,010 | 1/1979 | Pilie et al. | 210/164 |
| 4,578,188 | 3/1986 | Cousino | 210/170 |
| 4,985,148 | 1/1991 | Monteith | 210/532.1 |
| 5,298,172 | 3/1994 | Smith | 210/154 |

*Primary Examiner*—Christopher Upton
*Attorney, Agent, or Firm*—Shoemaker and Mattare, Ltd.

[57] ABSTRACT

A tank interceptor for rain water and waste-water includes a container which has an intermediate partition dividing the chamber into a by-pass compartment above the partition and a treatment compartment below. An inlet is positioned adjacently above the partition and an outlet is also positioned adjacently above the partition, but spaced away from the inlet. The partition includes a raised portion isolating the inlet from the outlet, such that liquid entering through the inlet and seeking to reach the outlet through the by-pass compartment must overlow the raised portion in order to do so. Openings are provided through the partition on the inlet side and the outlet side of the raised portion, and communicate the by-pass compartment with the treatment compartment. The openings are such that liquid, without having to overflow the raised portion, can travel from the inlet to the outlet through the treatment compartment.

5 Claims, 4 Drawing Sheets

TANK INTERCEPTOR

This invention relates generally to separator tanks, sometimes called interceptors, adapted to receive primarily rainwater from a storm sewer or drain, and additionally to perform the function of separating and entrapping any oil- or gasoline-based materials and suspended solids that may enter, allowing the water fraction to discharge into municipal receiving sewers. Prior art devices of this kind are typically equipped with various baffles and chambers operating in such a way as to collect specific components of the waste fluid and separate them from others.

In this connection, reference may be had to U.S. Pat. No. 4,136,010, issued Jan. 23, 1979 to Pilie et al.

Other patents, only peripherally related to the subject matter of this specification, are as follows:

U.S. Pat. No. 1,844,443, Schmidt, Feb. 9, 1932;
U.S. Pat. No. 942,907, Huff, Dec. 14, 1909;
U.S. Pat. No. 3,567,024, McCormick, Mar. 2, 1971;
U.S. Pat. No. 3,221,881 Weiler et al, Dec. 7, 1965.

PRIOR ART

An improved construction is the subject of U.S. Pat. No. 4,985,148, issued Jan. 15, 1991 to Joseph G. Monteith, and entitled, "Improved Separator Tank Construction". The purpose of the tank interceptor set forth in the latter patent is to provide two distinct responses to two different operating conditions:

(1) When the materials entering the interceptor include discharge from a service station, garage, machine shop, factory or the like, or oil that has spilled accidentally, these non-aqueous materials are collected within the interceptor. The aqueous fraction is allowed to leave the interceptor and pass on to a storm sewer or the like, but the liquid fraction made up of oil or fat of animal, vegetable or mineral origin, gasoline and the like remains trapped within the interceptor until the same is pumped out. Further, any heavier-than-water materials sink to the bottom of the interceptor and are confined to a particular location from where they can also be pumped out at intervals.

(2) The interceptor of the prior invention is also adapted to deal with inflow resulting from heavy rain during a storm. Such inflow would typically be a combination of storm drainage from an adjacent industrial property, garage or the like, as well as inflow from storm drains adapted to catch rainwater. When a large quantity of rainwater arrives at the interceptor of the prior invention, the interceptor automatically diverts most of this flow directly to an outlet opening which passes it directly to a storm sewer. Only a portion of the flow of the incoming rainwater is allowed through the treatment/storage chamber of the interceptor.

To accomplish the aforesaid goals, the prior art separator provides, within the tank-like interceptor, a passageway extending substantially directly between the inlet and the outlet. The passageway is essentially sealed from communication with the remainder of the interior of the tank interceptor, except for an opening adjacent the inlet and an opening adjacent the outlet. Each opening communicates the passageway with the remainder of the tank interior, which may be regarded as a treatment chamber. Finally, a weir means is provided within the passageway, disposed with respect to the first opening such that, under relatively low entry flow rates, all entering materials are contained by the weir and flow through the first opening and into the treatment chamber, whereas under relatively high entry flow rates, part of the entering materials overflow the weir and are delivered by the passageway to the outlet.

It has now been recognized that it is not necessary for the entire volume inside the interceptor tank (except for the passageway means) to be used as a treatment chamber. Also, it is considered desirable that the means providing the high-flow passageway be more fully accessible to personnel wishing to inspect the installation for damage, improper accumulations of materials, etc. Accordingly, it is an aim of one aspect of this invention to provide a separator tank construction having a treatment compartment in the bottom portion thereof and a convenient area where inspection personnel may stand, with these two volumes being separated from each other in an air-tight manner. It is the aim of a further aspect of this invention to provide means defining a passageway or channel which is upwardly open, and which can be inspected directly by personnel in the inspection (upper) compartment.

It is an aim of a further aspect of this invention to provide flexibility as to the relative positions and peripheral spacing of the inlet and the outlet of the separator tank.

GENERAL DESCRIPTION OF THIS INVENTION

More particularly, this invention provides a tank interceptor for rainwater and waste-water, comprising:

a container including a bottom wall, a side wall and a top wall, said walls defining an internal chamber, a partition dividing the chamber into a by-pass compartment above the partition and a treatment compartment below the partition, the partition having a top wall, an inlet through the side wall adjacently above the top wall, the inlet being adapted to permit liquid to flow into the by-pass compartment, an outlet through the side wall adjacently above the top wall and spaced away from the inlet, the outlet being adapted to permit liquid to flow out of said by-pass compartment, the top wall of the partition being configured to include a raised portion which isolates the inlet from the outlet, such that liquid entering through the inlet and seeking to reach the outlet through the by-pass compartment must overflow the raised portion in order to do so, and first and second openings through the partition on the inlet side and the outlet side, respectively, of the raised portion, both openings communicating the by-pass compartment with the treatment compartment, the openings being such that liquid, without having to overflow said raised portion, can travel from the inlet to the outlet by passing through the first opening into the treatment compartment, thence through the treatment compartment, thence through the second opening into the by-pass compartment, thence to the outlet.

BRIEF DESCRIPTION OF THE DRAWINGS

Two embodiments of this invention are illustrated in the accompanying drawings, in which like numerals denote like parts throughout the several views, and in which.

DETAILED DESCRIPTION OF THE DRAWINGS

Figure 5:
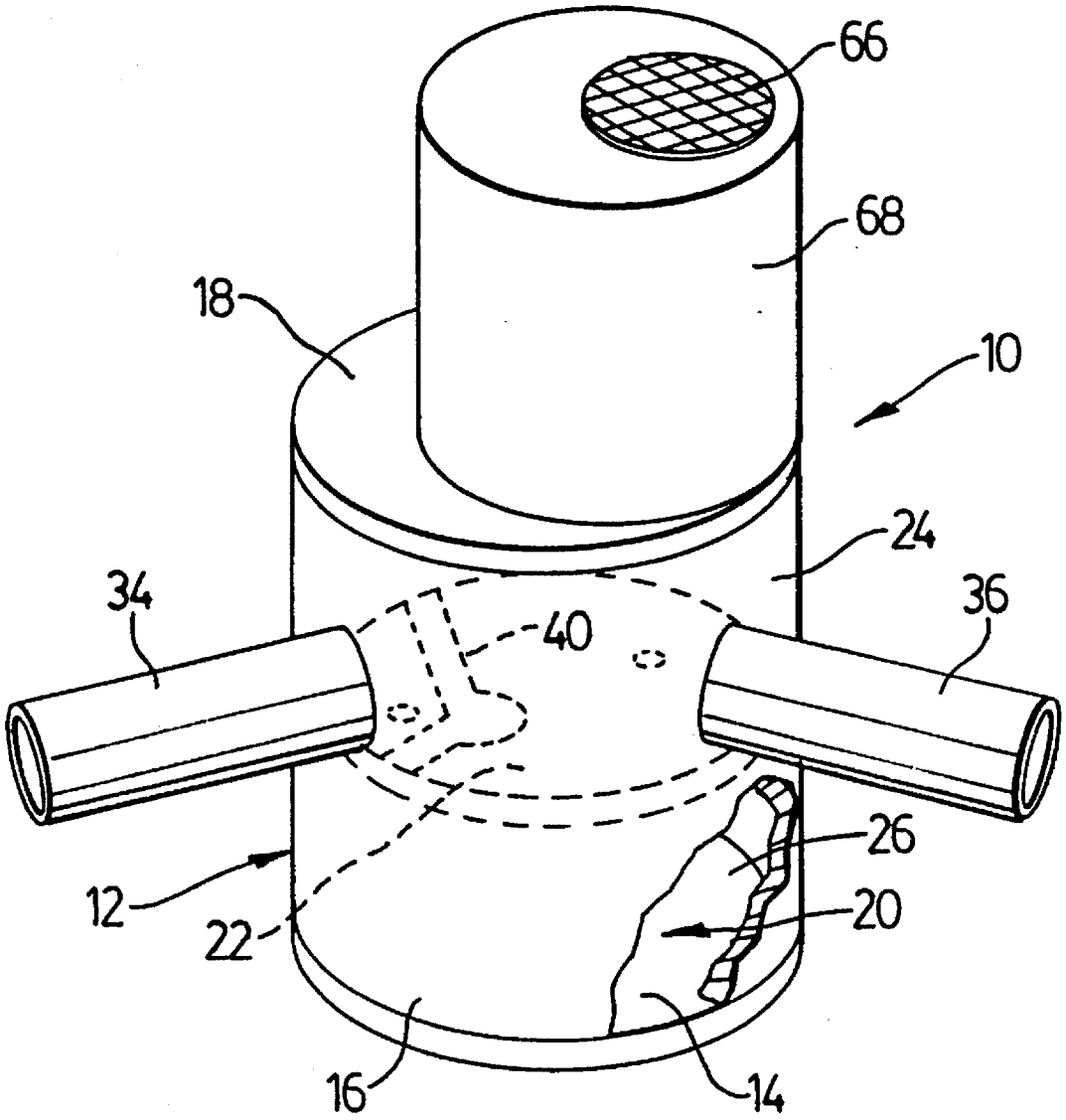
FIG. 5 is a somewhat schematic view, to a smaller scale, of a complete tank interceptor installation in accordance with the first embodiment of this invention.

Attention is first directed to FIG. 5, which shows a tank interceptor generally at the numeral 10, the interceptor being generally in the shape of a container 12 that has a bottom wall 14, a side wall 16 and a top wall 18. It will be noted that the bottom and top walls 14 and 18 are circular, flat and horizontal, whereas the side wall of the embodiment illustrated in FIG. 5 is substantially cylindrical. The bottom wall 14, side wall 26 and top wall 18 define an internal chamber 20.

A partition seen in broken lines at the numeral 22 divides the chamber 20 into a by-pass compartment 24 above the partition 22 and a treatment compartment 26 below the partition 22.

In the embodiment illustrated in FIGS. 1, 2 and 5, the partition 22 has a top surface 28, the major portion of which lies substantially in a single horizontal plane, except for a raised portion which will be described subsequently.

The side wall 16 has an inlet opening 30 adjacently above the top surface 28 of the partition 22, and has an outlet opening 32 adjacently above the top surface 28 and spaced peripherally away from the inlet opening 30. Connected to the inlet opening 30 is a conduit 34 through which liquid can be admitted to the compartment 24 above the partition 28. Likewise, a conduit 36 is connected to the outlet opening 32 and is adapted to allow liquid to flow out of the by-pass compartment 24.

Figure 1:
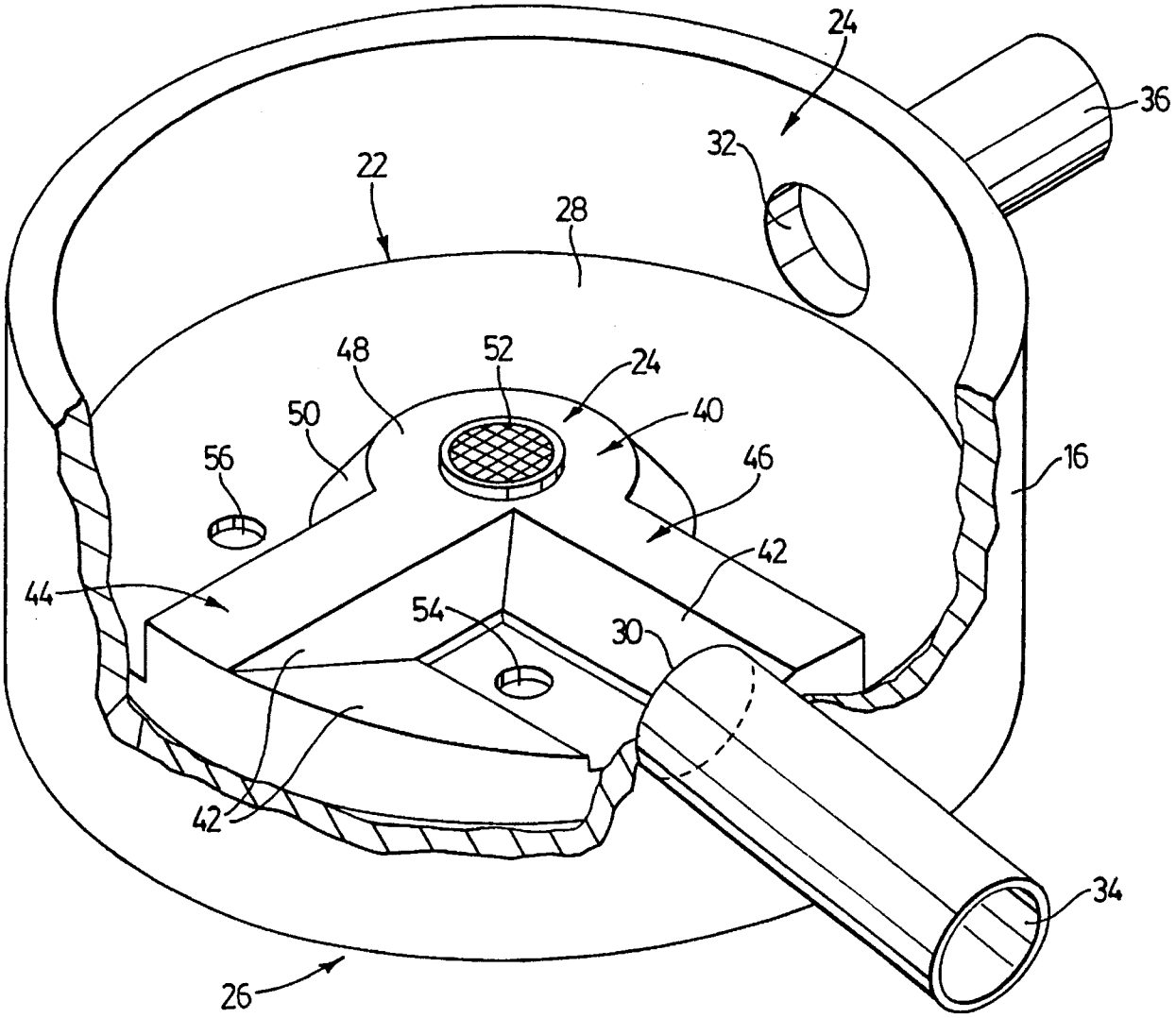
FIG. 1 is a perspective view of an intermediate partition of a first embodiment of this invention within a cylindrical chamber, dividing the chamber into upper and lower compartments.

As particularly seen in FIG. 1, the flat top surface 28 of the partition 22 is configured to include a raised portion shown generally at 40 which isolates the inlet opening 30 from the outlet opening 32, such that liquid entering through the inlet opening 30 and seeking to reach the outlet opening 32 through the by-pass compartment must overflow the raised portion 40 in order to do so.

More particularly, the raised portion 40 has the shape of an elongate weir with a sloping sidewall 42 in the direction of the inlet opening 30. The sloping sides serve to minimize turbulence in the liquid.

Still more particularly, the raised portion 40 shown in FIG. 1, is essentially trapezoidal in cross-section, and has two arms 44 and 46 which are disposed substantially radially with respect to the cylindrical side wall 16, meeting at a part-circular hub 48 which includes a part-frusto-conical side wall 50 and also defines a central opening through the partition, the opening being sealable by a man-hole cover 52.

Still referring to FIG. 1, the interceptor includes a first opening 54 through the partition 22 on the inlet side of the weir constituted by the raised portion 40, and has a second opening 56 on the outlet side of the raised portion 40, the second opening 56 also extending through the partition 22. The openings 54 and 56 are such that liquid, without having to overflow the raised portion 40, can travel from the inlet opening 30 to the outlet opening 32 by passing through the first opening 54 into the treatment compartment below the partition 22, thence through the treatment compartment, thence through the second opening 56 into the by-pass compartment 24, thence directly to the outlet opening 32.

It is to be noted that the second opening 56 can be located anywhere on the portion of the top surface 28 of the partition 22 which is on the "outlet" side of the weir constituted by the raised portion 40.

Figure 2:
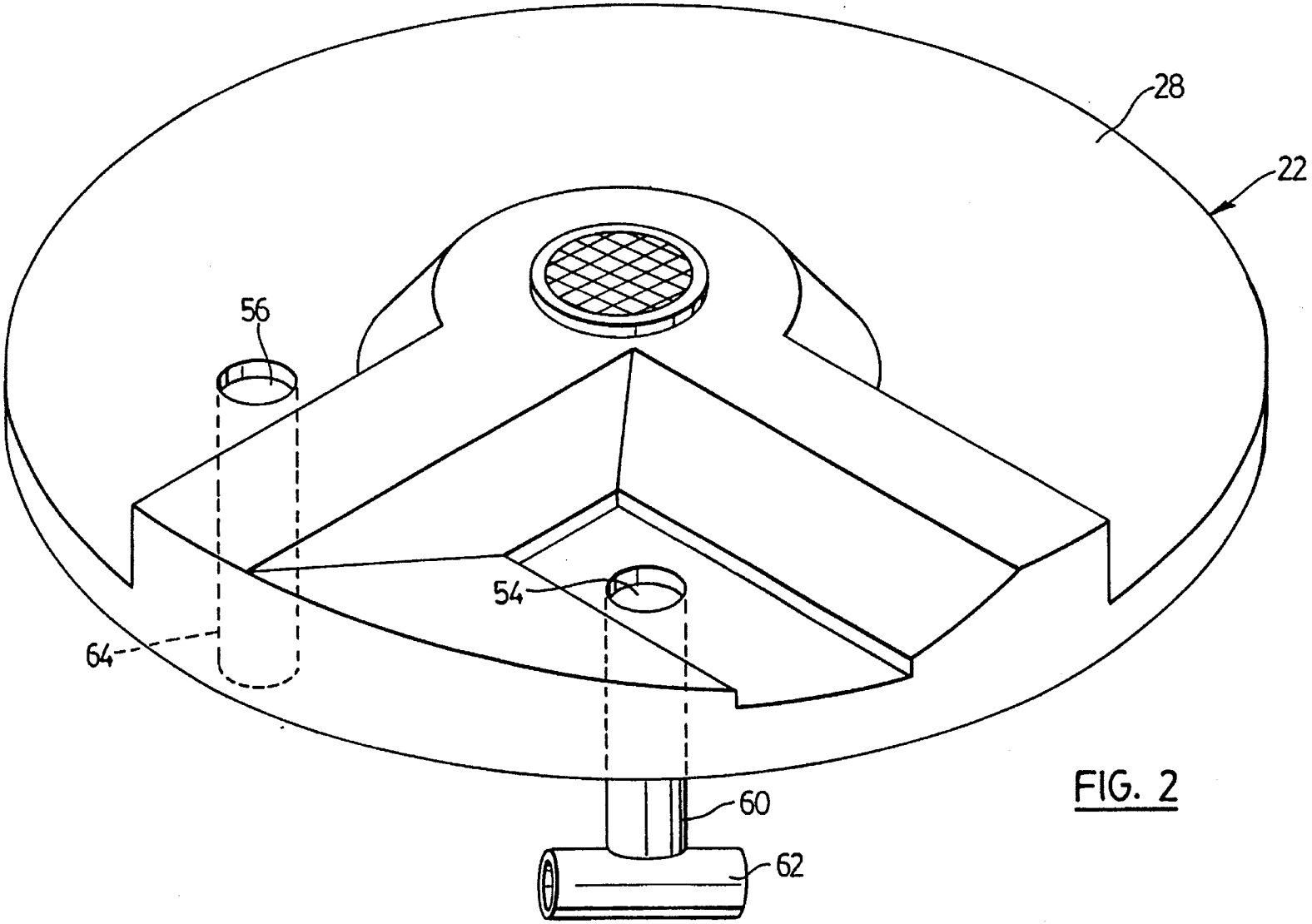
FIG. 2 is a perspective view of the said partition, to a larger scale.

As illustrated in FIG. 2, the preferred embodiment of the invention includes a drop pipe 60 connected to and extending downwardly from the first opening 54 and having a T-shape 62 at the bottom, in order to distribute entering liquid in opposite directions within the treatment compartment.

Similarly, the second opening 56 communicates with and is connected to a riser pipe 64 which allows upflow of liquid from the treatment compartment to the by-pass compartment.

Returning to FIG. 5, it will be noted that the interceptor includes an access man-hole 66 located eccentrically with respect to a cylindrical extension 68, which in turn is located eccentrically with respect to the main interceptor container 12, and extends upwardly from the top wall 18 thereof. The eccentricities are in the same direction, so that a vertical ladder may be provided for a worker wishing to climb down through the man-hole opening and to stand on the partition 22.

Figure 3:
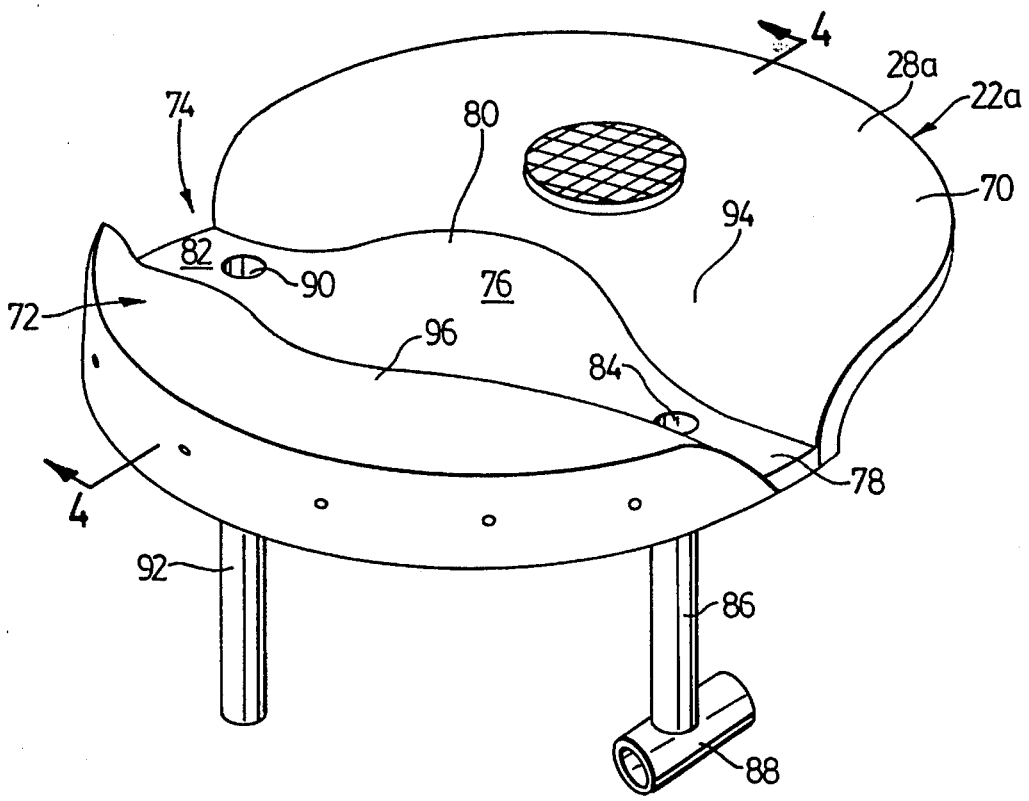
FIG. 3 is a perspective view of a further embodiment of the partition of this invention.
Figure 4:
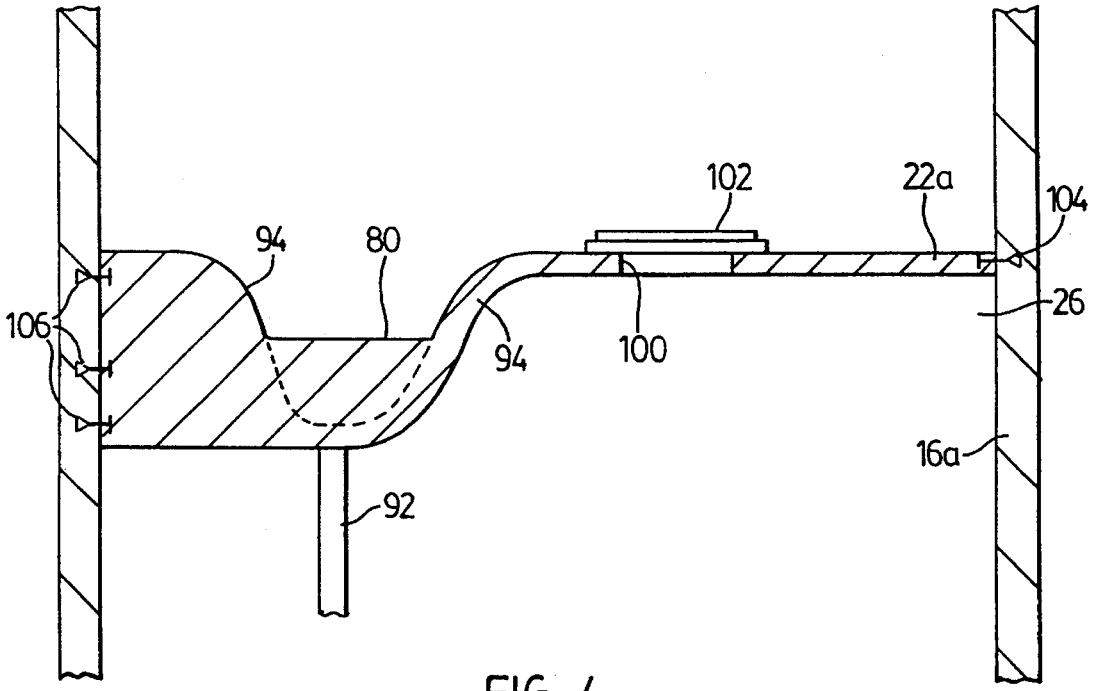
FIG. 4 is a vertical sectional view, taken at the line 4—4 in FIG. 3.

Attention is now directed to FIGS. 3 and 4, for a description of the second embodiment of this invention.

In FIGS. 3 and 4, a partition **22*a* is again shown, but the top surface thereof differs from that shown in FIG. 1. Specifically, the top surface 28*a* of the partition 22*a* includes a semi-circular portion 70, and a downwardly recessed portion 72. More specifically, the recessed portion 72 defines a channel 74 having a floor 76 which begins rightwardly at a depressed level 78, then rises to define a weir 80, and then again falls to a lower level 82. The raised portion 80 functions in the same way as the raised portion 40 shown in FIG. 1. At the depressed level 78 there is provided a first opening 84 connected to a drop pipe 86, in turn connected to a T-fitting 88, all of the latter serving the same function as the components 54, 60 and 62 shown in FIG. 2**.

Likewise, there is provided at the depressed level 82 a second opening 90 which is connected to a riser pipe 92, these having the same function as the second opening 56 and riser pipe 54 shown in FIG. 2.

The remainder of the second half of the partition **22*a* provides side walls 94 and 96 which define a channel along which liquid arriving in quantity can flow from an inlet opening through the cylindrical side wall adjacent the depress level 78, to an outlet opening through the side wall adjacent the depressed region 82**.

An access opening 100 through the flat semi-circular portion 70 of the partition **22*a* allows access to the treatment chamber 26 under the partition 22*a*, and a man-hole cover 102 is adapted to achieve an air-tight seal. It will be noted that fastening means 104 and 106 are provided in the cylindrical wall 16*a* of the second embodiment, in order to secure the partition 22*a*** in place.

The use of the interceptor illustrated in the drawings will now be described. After installation and hook-up, the interceptor would be filled with clean water, up to a level which is slightly below the bottom of the partition (22, **22*a*), this being a level which is above the bottoms of the drop pipe 86 and the riser pipe 92. The garage, service station or the like with which the interceptor is associated may produce a certain amount of waste-water mixed with oil, grit, etc., and this can find its way into the sewer which connects with the inlet opening 30. When there is no rain, the only material which can reach the interceptor would be that produced by the operation of the service station or the like. This flow will be relatively low, and will pass through the first opening 54 and down the drop pipe 86 to the T-fitting 88, thus entering the treatment compartment below the partition 22, 22***a*, without having to overflow the raised portion (weir). As aqueous and non-aqueous materials flow into the treatment compartment 26, there will be some gravity flow of water through the riser pipe 92 and out of the outlet opening 32. As more non-aqueous materials enter, the "oil layer" will continue to increase in thickness, but only water will pass through the riser pipe 92 and out the outlet opening 32 until the oil layer becomes so thick that the interface between the oil and the water descends to the bottom of the riser pipe 92.

From time to time, the treatment chamber 26 will be inspected through the opening that is sealed by the man-hole cover 52. When it is noted that a large quantity of oil-based material has collected above the water in the treatment compartment, this material can be pumped out.

Imagine now that a rain storm occurs, and that suddenly the flow rate at which materials arrive at the interceptor goes up by a factor of 20. This will certainly overflow the weir constituted by the raised portion 40, 80, and practically the entire overflow will pass from the inlet opening 30 to the outlet opening 32 through the bypass compartment (above the partition 22, 22*a*).

During the by-pass of the torrent of rain water, some of it will pass downwardly along the pipe 60, causing water already in the treatment compartment 26 to be displaced upwardly along the riser pipe 92 and out of the outlet opening 32. However, so long as the oil film covering the water in the treatment compartment is not thick enough to equal the vertical height of the riser pipe 92, only water or aqueous liquids will pass upwardly along the riser pipe 92 and out the outlet opening 32.

It will be understood from the above description that the unit shown in the figures is designed to prevent oil and solids from discharging into municipal receiving sewers. As such, the unit constitutes an important spill-containment device, capable of retaining oil and other lighter-than-water liquids securely stored within the unit in a way that prevents them from being flushed into the municipal receiving sewers.

It is preferred that the unit described above be constructed of fibreglass, due to its strength and relative cheapness. However, other materials could be utilized. The compactness and light weight of the unit facilitates its installation, and by utilizing fibreglass the unit will be leak-proof, corrosion-proof and unaffected by frost.

While two embodiments of this invention have been illustrated in the accompanying drawings and described hereinabove, it will be evident to those skilled in the art that changed and modifications may be made therein without departing from the essence of this invention, as set forth in the appended claims.

What is claimed is:

1. A tank interceptor for rainwater and waste-water, comprising:

a container including a bottom wall, a side wall and a top wall, said walls defining an internal chamber, a partition dividing the chamber into a by-pass compartment above the partition and a treatment compartment below the partition, the partition having a top wall, an inlet through the side wall adjacently above the top wall of the partition, the inlet being adapted to permit liquid to flow into the by-pass compartment, an outlet through the side wall adjacently above the top wall and spaced away from the inlet, the outlet being adapted to permit liquid to flow out of said by-pass compartment, the top wall of the partition being configured to include a raised portion which isolates the inlet from the outlet, while being spaced from the top wall of the container to provide means such that liquid entering through the inlet and seeking to reach the outlet through the by-pass compartment must overflow the raised portion in order to do so, and first and second openings through the partition on the inlet side and the outlet side, respectively, of the raised portion, both openings communicating the by-pass compartment with the treatment compartment, the openings being such that liquid, without having to overflow said raised portion, can travel from the inlet to the outlet by passing through the first opening into the treatment compartment, thence through the treatment compartment, thence through the second opening into the by-pass compartment, thence to the outlet.

2. The tank interceptor claimed in claim 1, in which the partition includes a passageway between the by-pass and treatment compartments, the passageway being sized to allow passage of a worker wishing to inspect the treatment compartment, and an access cover adapted to seal said passageway.

3. The tank interceptor claimed in claim 2, in which the top wall of the partition lies substantially in a single horizontal plane, except for said raised portion, which has the shape of an elongate weir with at least one sloping side in order to minimize turbulence in liquid overflowing the raised portion; and in which an elongate pipe extends downwardly from each said opening into said treatment compartment.

4. The tank interceptor claimed in claim 1, in which the top wall of the partition lies substantially in a single horizontal plane, except for said raised portion, which has the shape of an elongate weir with at least one sloping side in order to minimize turbulence in liquid overflowing the raised portion.

5. The tank interceptor claimed in claim 1, in which an elongate pipe extends downwardly from each said opening into said treatment compartment.

* * * * *

US005498331C1

(12) EX PARTE REEXAMINATION CERTIFICATE (6370th)

United States Patent

Monteith

(10) Number: US 5,498,331 C1

(45) Certificate Issued: Aug. 19, 2008

(54) TANK INTERCEPTOR

(75) Inventor: Joseph G. Monteith, Mississauga (CA)

(73) Assignee: Stormceptor Corporation, Rockville, MD (US)

Reexamination Request:
No. 90/007,769, Oct. 19, 2005

Reexamination Certificate for:

| | |
|---|---|
| Patent No.: | **5,498,331** |
| Issued: | **Mar. 12, 1996** |
| Appl. No.: | **08/337,393** |
| Filed: | **Nov. 8, 1994** |

(51) Int. Cl.

| | |
|---|---|
| ***E03F 5/016*** | (2006.01) |
| ***E03F 5/014*** | (2006.01) |
| ***E03F 5/01*** | (2006.01) |
| ***E03B 3/00*** | (2006.01) |
| ***E03B 3/003*** | (2006.01) |

(52) U.S. Cl. ..... 210/170.03; 210/521; 210/532.1; 210/538; 405/60

(58) Field of Classification Search ..... None

See application file for complete search history.

(56) References Cited

U.S. PATENT DOCUMENTS 4,985,148 A 1/1991 Monteith

OTHER PUBLICATIONS

Marsalek, "Laboratory Testing of Stormceptor I," National Water Research Institute, Burlington, Ontario, May 1993.

*Primary Examiner*—Jerry D. Johnson

(57) ABSTRACT

A tank interceptor for rain water and waste-water includes a container which has an intermediate partition dividing the chamber into a by-pass compartment above the partition and a treatment compartment below. An inlet is positioned adjacently above the partition and an outlet is also positioned adjacently above the partition, but spaced away from the inlet. The partition includes a raised portion isolating the inlet from the outlet, such that liquid entering through the inlet and seeking to reach the outlet through the by-pass compartment must overlow the raised portion in order to do so. Openings are provided through the partition on the inlet side and the outlet side of the raised portion, and communicate the by-pass compartment with the treatment compartment. The openings are such that liquid, without having to overflow the raised portion, can travel from the inlet to the outlet through the treatment compartment.

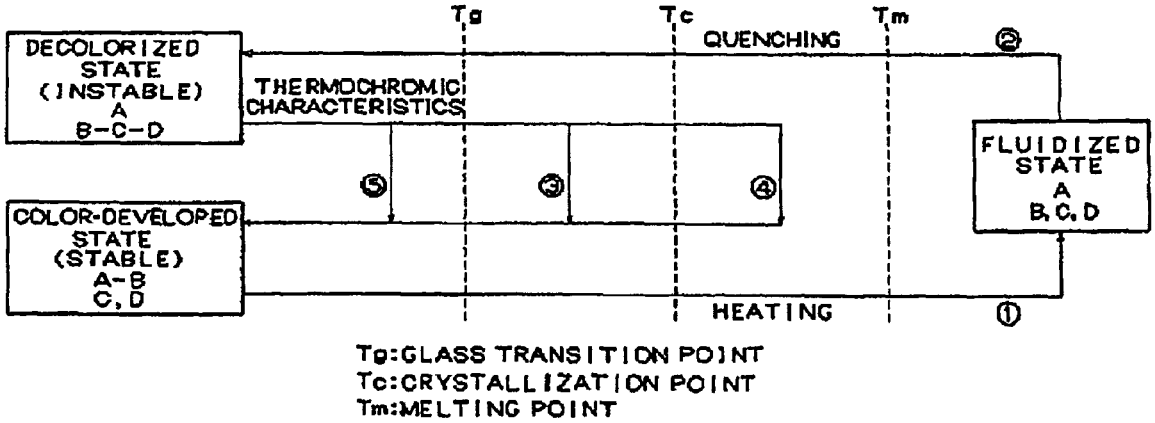

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 2 and 4 are determined to be patentable as amended.

Claims 3 and 5, dependent on an amended claim, are determined to be patentable.

1. A tank interceptor for rainwater and waste-water, comprising:

a container including a bottom wall, a side wall and a top wall, said walls defining an internal chamber, a partition dividing the chamber into a by-pass compartment above the partition and a treatment compartment *located entirely* below the partition, the partition having a top wall, an inlet through the side wall adjacently above the top wall of the partition, the inlet being adapted to permit liquid to flow into the by-pass compartment, an outlet through the side wall adjacently above the top wall and spaced away from the inlet, the outlet being adapted to permit liquid to flow out of said by-pass compartment, the top wall of the partition being configured to include a raised portion which isolates the inlet from the outlet, while being spaced from the top wall of the container to provide means such that liquid entering through the inlet and seeking to reach the outlet through the by-pass compartment must overflow the raised portion in order to do so, and first and second openings through the partition on the inlet side and the outlet side, respectively, of the raised portion, both openings communicating the by-pass compartment with the treatment compartment, the openings being such that liquid, without having to overflow said raised portion, can travel from the inlet to the outlet by passing through the first opening into the treatment compartment, thence through the treatment compartment, thence through the second opening into the by-pass compartment, thence to the outlet.

2. [The] *A* tank interceptor [claimed in claim 1, in which] *for rainwater and waste-water, comprising:*

*a container including a bottom wall, a side wall and a top wall, said walls defining an internal chamber,*

*a partition dividing the chamber into a by-pass compartment above the partition and a treatment compartment below the partition, the partition having a top wall,*

*an inlet through the side wall adjacently above the top wall of the partition, the inlet being adapted to permit liquid to flow into the by-pass compartment,*

*an outlet through the side wall adjacently above the top wall and spaced away from the inlet, the outlet being adapted to permit liquid to flow out of said by-pass compartment,*

*the top wall of the partition being configured to include a raised portion which isolates the inlet from the outlet, while being spaced from the top wall of the container to provide means such that liquid entering through the inlet and seeking to reach the outlet through the by-pass compartment must overflow the raised portion in order to do so, and*

*first and second openings through the partition on the inlet side and the outlet side, respectively, of the raised portion, both openings communicating the by-pass compartment with the treatment compartment, the openings being such that liquid, without having to overflow said raised portion, can travel from the inlet to the outlet by passing through the first opening into the treatment compartment, thence through the treatment compartment, thence through the second opening into the by-pass compartment, thence to the outlet; and*

*wherein* the partition includes a passageway between the by-pass and treatment compartments, the passageway being sized to allow passage of a worker wishing to inspect the treatment compartment, and an access cover adapted to seal said passageway *and thereby seal said treament compartment from said by-pass compartment*.

4. [The] *A* tank interceptor [claimed in claim 1, in which] *for rainwater and waste-water, comprising:*

*a container including a bottom wall, a side wall and a top wall, said walls defining an internal chamber,*

*a partition dividing the chamber into a by-pass compartment above the partition and a treatment compartment below the partition, the partition having a top wall,*

*an inlet through the side wall adjacently above the top wall of the partition, the inlet being adapted to permit liquid to flow into the by-pass compartment,*

*an outlet through the side wall adjacently above the top wall and spaced away from the inlet, the outlet being adapted to permit liquid to flow out of said by-pass compartment,*

*the top wall of the partition being configured to include a raised portion which isolates the inlet from the outlet, while being spaced from the top wall of the container to provide means such that liquid entering through the inlet and seeking to reach the outlet through the by-pass compartment must overflow the raised portion in order to do so, and*

*first and second openings through the partition on the inlet side and the outlet side, respectively, of the raised portion, both openings communicating the by-pass compartment with the treatment compartment, the openings being such that liquid, without having to overflow said raised portion, can travel from the inlet to the outlet by passing through the first opening into the treatment compartment, thence through the treatment compartment, thence through the second opening into the by-pass compartment, thence to the outlet; and*

*wherein* the top wall of the partition *comprises a surface that* lies substantially in a single horizontal plane[, except for] *and* said raised portion, [which] *said raised portion* has the shape of an elongate weir with at least one sloping side in order to minimize turbulence in liquid overflowing the raise portion, *and the surface that lies in substantially a single horizontal plane comprises the majority of the top wall of the partition*.

* * * * *